US008356779B2

(12) United States Patent
Stengel

(10) Patent No.: US 8,356,779 B2
(45) Date of Patent: Jan. 22, 2013

(54) FIXED FLAT PANEL MONITOR MOUNTING SYSTEM

(76) Inventor: Jasen A. Stengel, Columbia, MD (US)

( * ) Notice: Subject to any disclaimer, the term of this patent is extended or adjusted under 35 U.S.C. 154(b) by 498 days.

(21) Appl. No.: 12/455,981

(22) Filed: Jun. 10, 2009

(65) Prior Publication Data

US 2009/0308991 A1 Dec. 17, 2009

Related U.S. Application Data

(60) Provisional application No. 61/061,053, filed on Jun. 12, 2008.

(51) Int. Cl.
*A47F 5/00* (2006.01)

(52) U.S. Cl. ..... 248/125.3; 248/125.1; 248/125.8; 248/161; 248/920; 248/919

(58) Field of Classification Search ..... 248/161, 248/405, 157, 125.8, 125.1, 122.1, 121, 917, 248/919, 920, 922, 923, 205.1, 278.1, 284.1, 248/285.1, 286.1, 333, 327, 125.3, 126, 125.2; 108/25, 50.01, 50.02, 26; 312/223.3, 196; 348/844, 825, 794
See application file for complete search history.

(56) References Cited

U.S. PATENT DOCUMENTS 1,398,601 A * 11/1921 Osterhout ..... 248/457
3,358,957 A * 12/1967 Lindenmuth ..... 248/279.1
4,684,097 A * 8/1987 Cox ..... 248/354.3
5,082,037 A * 1/1992 Hammons et al. ..... 144/286.5
5,199,773 A * 4/1993 Price et al. ..... 312/7.2
5,207,405 A * 5/1993 Cobb ..... 248/411
5,352,033 A * 10/1994 Gresham et al. ..... 312/312
5,368,377 A * 11/1994 Baines ..... 312/27
6,170,406 B1 * 1/2001 Klein et al. ..... 108/50.01
6,234,331 B1 * 5/2001 Brandenberg ..... 211/205
6,708,940 B2 * 3/2004 Ligertwood ..... 248/324
6,802,577 B2 * 10/2004 Gershfeld ..... 312/223.3
7,063,311 B1 * 6/2006 Ascolese ..... 269/69
7,267,314 B1 * 9/2007 Erickson ..... 248/333
7,784,412 B2 * 8/2010 Korber et al. ..... 108/25
7,946,548 B2 * 5/2011 Sun ..... 248/231.31
2005/0139742 A1 * 6/2005 Frisell ..... 248/317
2007/0278361 A1 * 12/2007 May et al. ..... 248/126

* cited by examiner

*Primary Examiner* — Kimberly Wood
(74) *Attorney, Agent, or Firm* — Conwell Law LLC; H. Robert Field, Esq

(57) ABSTRACT

An adjustable flat panel monitor mounting system designed for strength and security is provided. The mounting system allows any VESA compliant flat panel display to be securely mounted to any work-surface. The height can be adjusted from sub-surface to super-surface upon installation and fixed in place with security screws. The user of the display would be able to adjust the angle of the display. The mount of the invention is fixed in place and can not be removed without special tools. The monitor is not able to be knocked off the work surface, and a bar is provided as a channel for wire management. The monitor can be used in the semi-recessed and subsurface configurations.

6 Claims, 7 Drawing Sheets

FIXED FLAT PANEL MONITOR MOUNTING SYSTEM

BACKGROUND

1. Field of the Invention

This invention relates to a fixed flat panel monitor mounting system to be installed on a work surface.

2. Background of the Invention

There are many commercially available computer and monitor furniture styles available on the market. These designs are based upon the need of the user, and the computer equipment that will be used. One style of furniture is described in published U.S. Application Nos. 2006/0191445 A1 (Stengel et al.) and 2006/0185564 A1 (Stengel et al.) which describe a flat panel workstation system which incorporates the means of supporting and pivoting a flat panel display such as a liquid crystal display (LCD) from a closed position to an open, viewable position in front of a user. Other furniture designs are marketed to be fitted to the user through the furniture to achieve the best balance between the user-equipment ergonomic interface.

Various means to mount a flat screen monitor to a work surface are known in the art. U.S. Pat. No. 4,766,422 (Wolters et al.) discloses a computer desk which enables the user to raise a flat screen display from beneath a work surface. U.S. Pat. No. 5,957,059 (Burhman) discloses a computer desk which includes a mount for various monitors, including a flat panel. U.S. Pat. Nos. 5,651,594, 5,699,744 5,964,164, 6,092,883, 6,135,298, 6,431,377 (Lechman) disclose flat monitor attachments to a work station inset into the work platform so as not to be interfacing with the top surface and displayed under a transparent work surface. U.S. Pat. No. 6,128,186 (Feierbach) discloses a workstation incorporating an integrated flat screen monitor which can be folded into a closed position where the viewing area is protected. U.S. Pat. No. 6,168,250 (Rogav) includes a flat panel monitor mounting assembly that allows the monitor to be rotated such that the monitor can be viewed in either a vertical or horizontal viewing position. U.S. Pat. No. 6,237,507 (Yanagisawa et al.) discloses a desk in which a flat panel monitor can be rotated into about a rotational axis. U.S. Pat. No. 6,286,440 (Jyringi) includes a desk with integrated computer components which includes a flat panel monitor component inset into the desk. U.S. Pat. No. 5,474,760 (Rauls) discloses a multifunction drawer for a desk that provides an adjustable platform, to which a flat panel monitor can be attached. U.S. Pat. No. 6,553,919 (Nevin) discloses a computer desk with a concealable flat panel display. U.S. Pat. No. 6,609,465 (Kolavo) discloses a multipurpose table to which a flat panel display can be mounted and raised to a user-determined position.

U.S. Design Pat. Nos. D429,088, D429,579, D438,401 (Lechman) disclose multiple station surface workstation units which can include a flat panel display and U.S. Design Pat. Nos. D437,506 and D440,069 (Lechman) disclose single work surface workstation units which can include a flat panel display. U.S. Pat. No. 7,047,980 (Korber et al.), and US Publication Nos. 2005/0145142 (Korber et al.), 2006/0185564 (Stengel and White) and 2006/0191445 (Stengel and White) disclose a method and system for holding and displaying a flat panel display monitor. U.S. Design Pat. D541,084 (Korber and Stengel) and U.S. application Ser. No. 29/253,938 (P. Stengel and J. Stengel; FIGS. 1-7 are incorporated by reference in their entirety) disclose a conference table with multiple workstations.

None of the patents or applications disclose or describe a mount for a flat panel monitor which both allows user adjustment and security of the monitor device. Security issues often drive decisions concerning costly equipment. There exists a need to optimize the best computer monitor location, based on environmental criteria, ergonomics and security of the monitor.

SUMMARY OF THE INVENTION

The present invention is drawn to a fixed flat panel monitor mounting system designed for strength and security. The design of the invention allows any VESA compliant flat panel display to be fixedly and securely mounted to a work-surface. The height can be adjusted from sub-surface to super-surface upon installation and fixed in place with security screws. The user of the display would be able to adjust the angle of the display only. The mount of the invention would be superior to the standard monitor stands because it is fixed in place and can not be removed without special tools. It can not be knocked off the table, and a bar is provided as a channel for wire management. It is also superior to standard monitor arms because it removes all the adjustment points that could distract users, but in spite of its security features, it can be used in the semi-recessed and subsurface configurations.

DETAILED DESCRIPTION OF THE INVENTION

Figure 1:
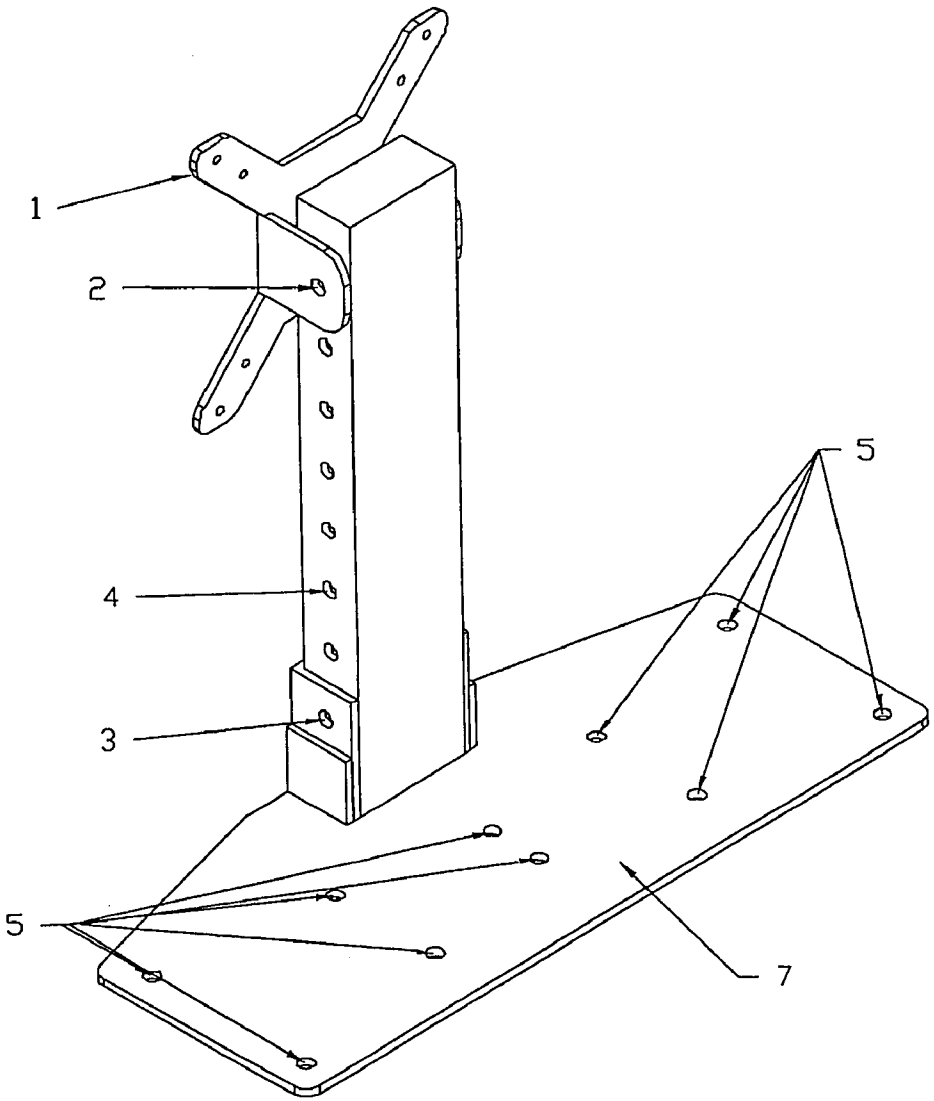
FIG. 1 depicts the back view of a semi-recessed or above mounting configuration of VESA standard flat panel monitor mount.

The present invention is drawn to a flat panel mounting system designed for strength and security. The target market would be institutional or educational users. Other possible users envisioned would be military, kiosk, industrial or other places that need a fixed mount on a work surface.

The present invention includes a VESA-compatible flat panel mounting system which can be used in any commercially-available work surface or workstation configurations, including, but not limited to single or multiple workstations, existing desks or tabletops, lectern or speakers' podiums, study carrels, library or classroom desks and tables, office or conference room work surfaces, tables, desks or modular work areas.

Video Electronics Standards Association (VESA) supports and sets industry-wide interface standards for the PC, workstation, and consumer electronics industries. VESA promotes and develops timely, relevant, open standards for the display and display interface industry, ensuring interoperability and encouraging innovation and market growth. VESA defines the requirements for the standardization of mechanical dimensions and selected electrical interface requirements panels intended for use as LCD monitors, designed to operate from various voltage sources, including 5 V and 12 V. This enables LCD manufacturers and panel consumers to better control supply and demand cycles. The intent is that panels built to VESA specification will be able to be used in most applications without requiring alterations in either the product tooling or the display module.

"Flat panel display" as used herein encompasses video displays that are lighter and much thinner than cathode ray (CRT) video displays that use cathode ray tubes, and are usually less than 4 inches (100 mm) thick. Flat panel displays usually require continuous refresh. These include, but are not limited plasma displays, liquid crystal displays (LCDs), organic light-emitting diode displays (OLEDs), light-emitting diode display (LED), electroluminescent displays (ELDs), surface-conduction electron-emitter displays (SEDs), field emission displays (FEDs), nano-emissive display (NEDs), and digital light processing (DLP). Other flat panel technologies include, but are not limited to bistable flat panel displays, also known as electronic paper displays, which includes, but are not limited to electrophoretic displays (such as E Ink's electrophoretic imaging film), bichromal ball displays (such as GYRICON (Xerox)), interferometric modulator displays (such as. IMOD, a MEMS display (Qualcomm)), cholesteric displays (such as, kent displays (MAG-INK)), and bistable nematic liquid crystal displays (ZBD).

The size of monitors of the invention includes but is not limited to 15, 17 19, 20, 21, 24 and 30 inch industry standard sized LCD monitors, or any other size known in the art. The invention also includes plasma monitors, or other flat panel display types as known in the art.

The VESA mounting configurations described in the invention are not limited to those that are shown. Adjustments and changes to said invention can be made, according to those of skill in the art. The channel (6) is not limited to the open channel for wire management, but the invention would include solid stock, or an enclosed channel, as needed for functionality. Friction washers can be made of any frictive material. The security screws or hard described throughout the invention can be substituted by and hardware known in the art and which provides suitable functionality. The VESA compatible mounting plate can be replaced with any mounting plate which meets other panel display mounting standards. The VESA standard hole placement of 100 mm and 75 mm on each side for vertical and horizontal hole separation can be changed to accommodate any changing display mounting standards and still be within the scope of the invention.

"Work surface" as used herein includes desks, flat commercially-available work surface or workstations, including, but not limited to single or multiple workstations, existing desks or tabletops, lectern or speakers' podiums, study carrels, library or classroom desks and tables, office or conference room work surfaces, tables, desks or modular work areas. The work surface could be contoured, horizontal to the floor, or angled. The work surface may also be portable, non-portable or fixedly attached to its location.

Working Examples

Figure 2:
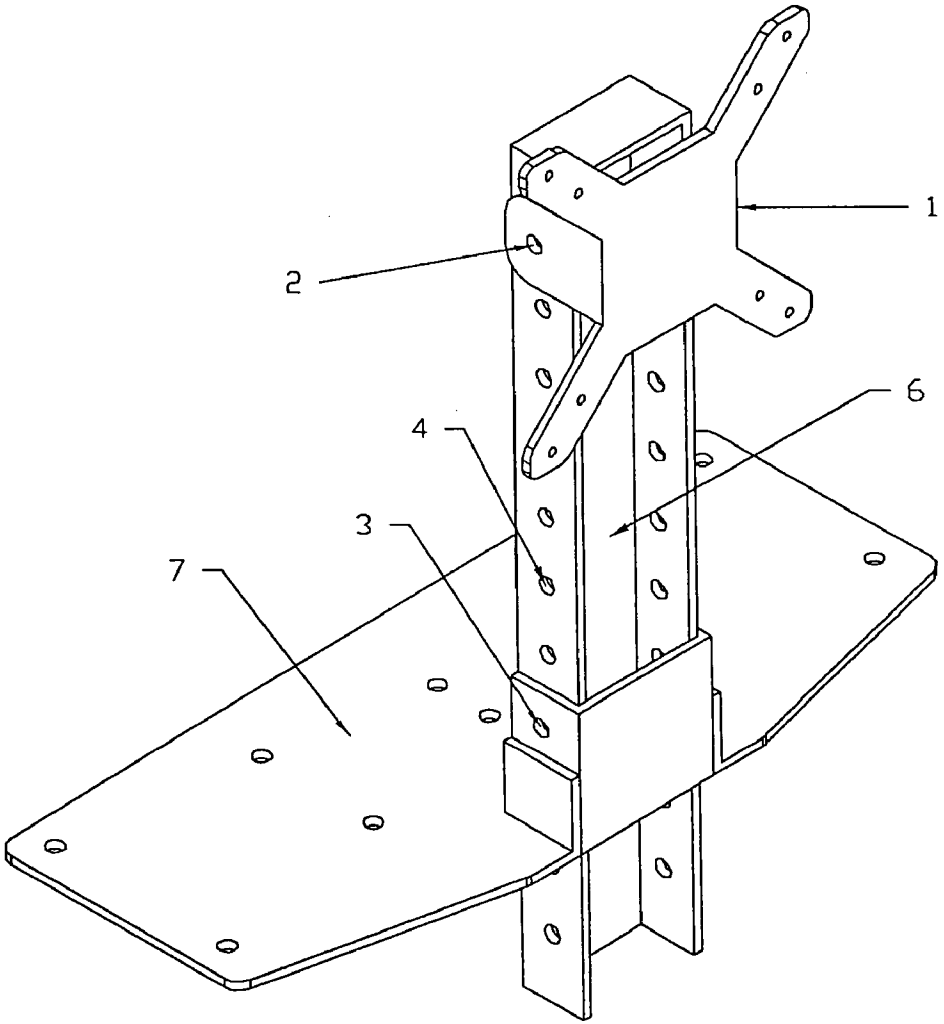
FIG. 2 shows the front view of a semi-recessed or above mounting configuration of VESA standard flat panel monitor mount.
Figure 3:
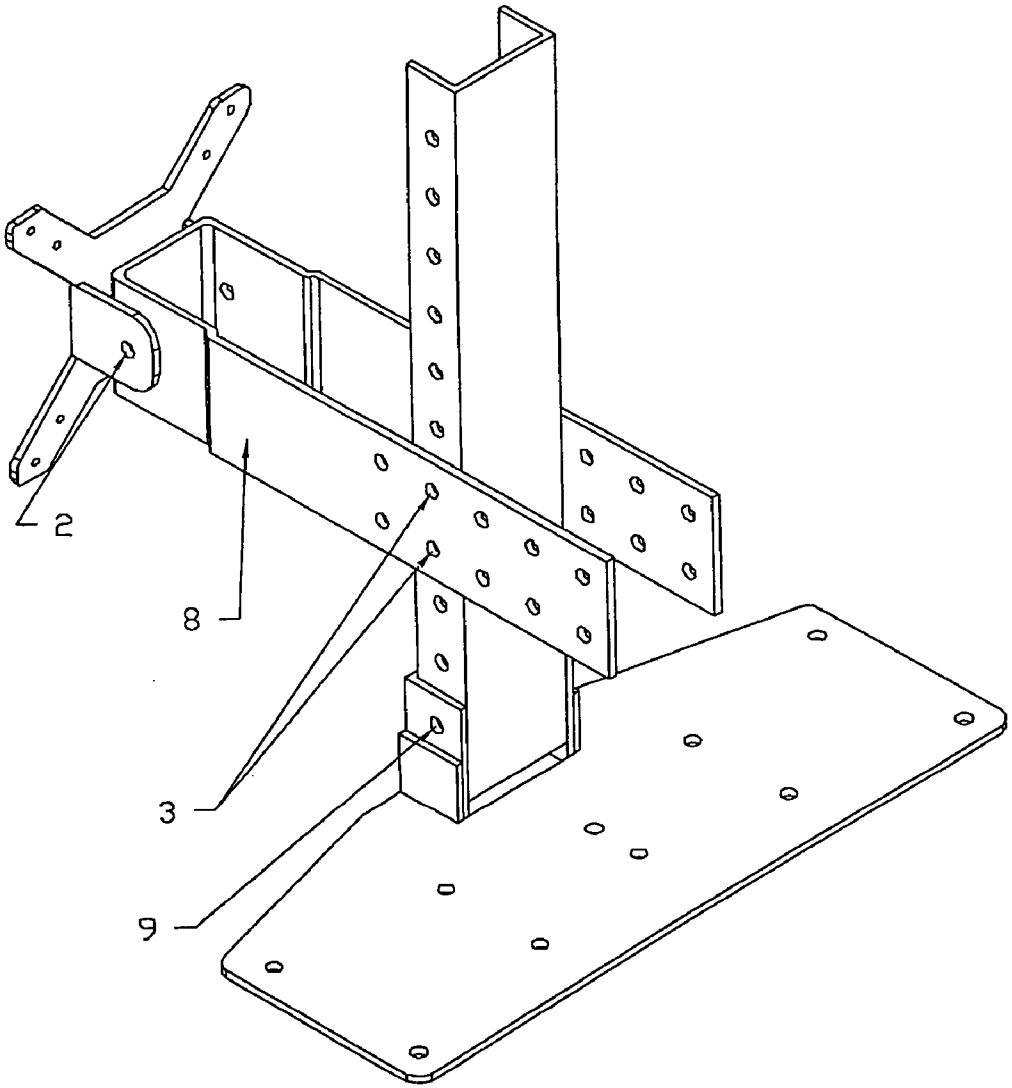
FIG. 3 depicts the back view of a semi-recessed or above mounting configuration of VESA standard flat panel monitor mount, adjusted to extend from the riser bar.

FIGS. 1-3 depict three views of a VESA compatible mounting plate (1). The mount can security screws (for example, IE HUDSON TPSS83206SBP) to attach the monitor. The VESA compatible mounting plate fits both the VESA 100 and VESA 75 standard mounting hole patterns on flat panel displays. (2) Mounting plate pivot point. Two security screws act as a tight pivot with friction damping washers (either felt or nylon) in between. The height set point (3) can use two security screws to fixedly set the height. The riser bar (4) (alternatively, the vertical support member) can adjust up or down upon installation, and can be changed with tools to change the height for new equipment or for a new configuration. The rise bar can be tapped for ¼-20 security screws for both the VESA mount pivot (2) and height set point (3). Optionally, the riser bar has a channel (6) for wires to pass through. The wire channel space allows monitor signal and power wires to be contained in the channel to keep them secure and protect them from accidental damage. (5) Work-surface mount holes. Security screws can be used to fixedly mount the bracket to the work-surface. The work surface mounting bracket (7) mounts to the underside of a work-surface either with the channel mount up or down, depending on the desired configuration.

Figure 4:
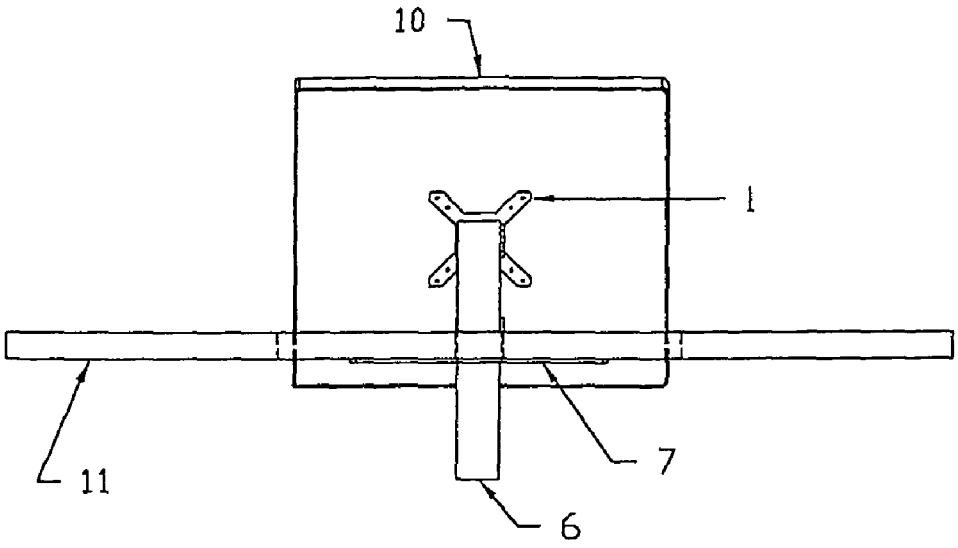
FIG. 4 depicts a back view of a semi-recessed mounted configuration of a flat panel monitor mounted on a standard work surface.
Figure 5:
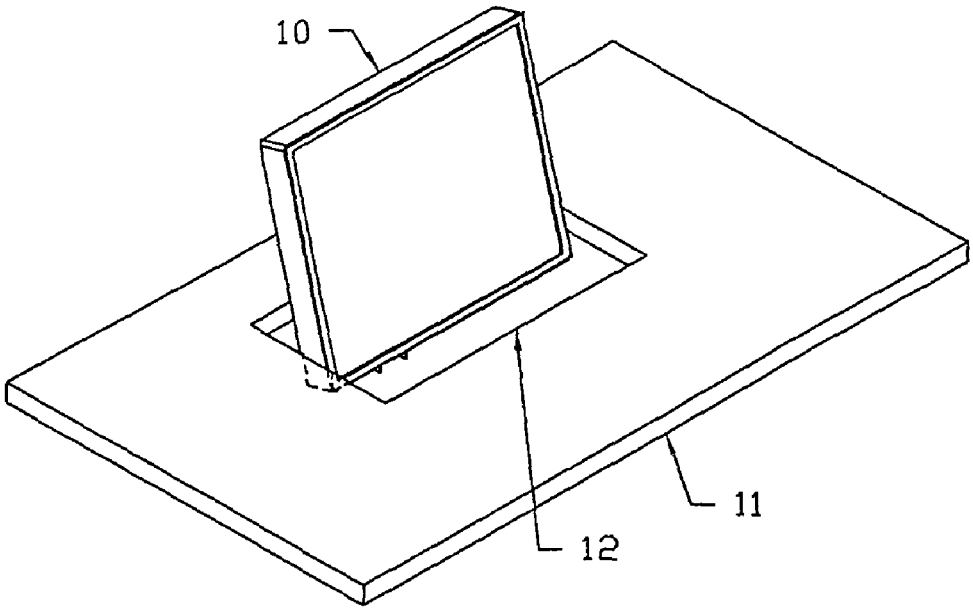
FIG. 5 shows is a front isometric view of a semi-recessed mounted configuration of a flat panel monitor mounted on a standard work surface.
Figure 6:
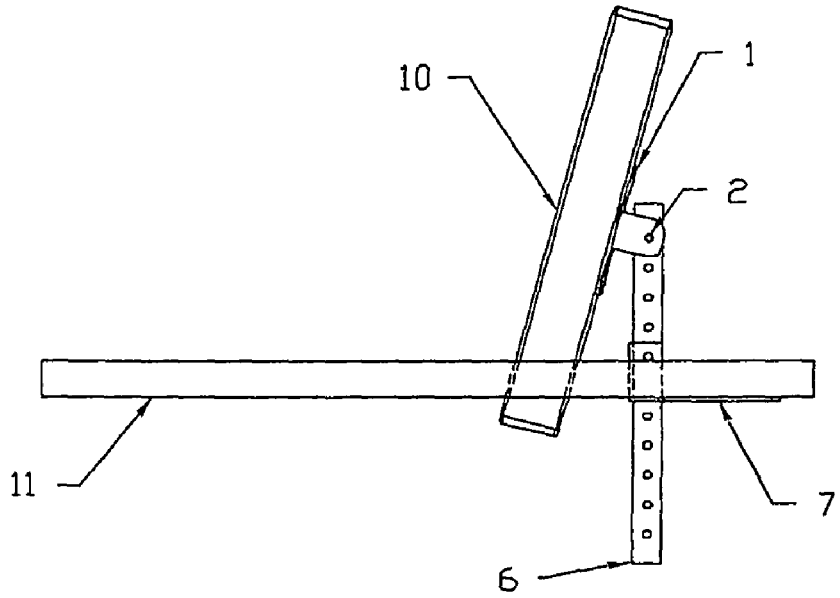
FIG. 6 depicts a side view of a semi-recessed mounted configuration of a flat panel monitor mounted on a standard work surface.
Figure 7:
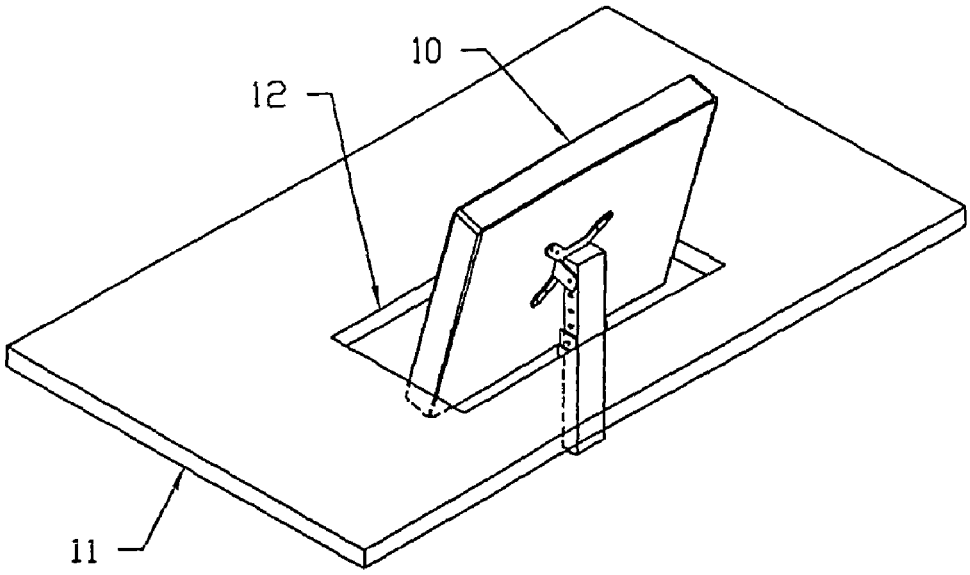
FIG. 7 depicts a back isometric view of a semi-recessed mounted configuration of a flat panel monitor mounted on a standard work surface.
Figure 8:
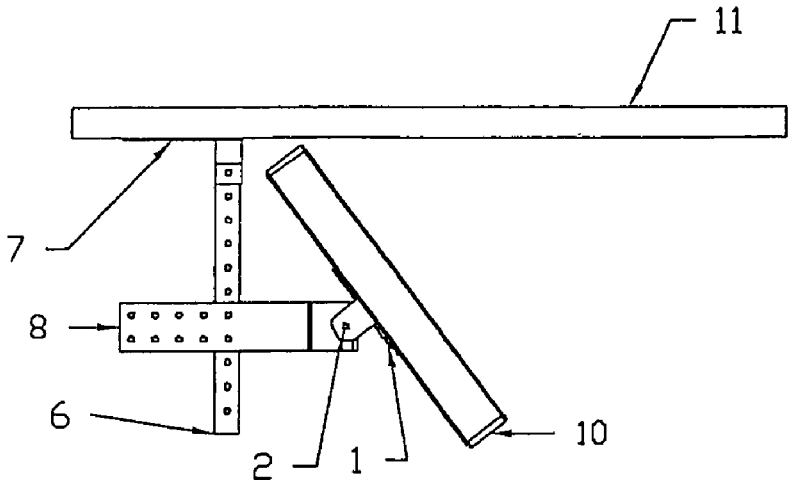
FIG. 8 shows a side view of a sub-surface configuration of a flat panel monitor mounted on a standard work surface.
Figure 9:
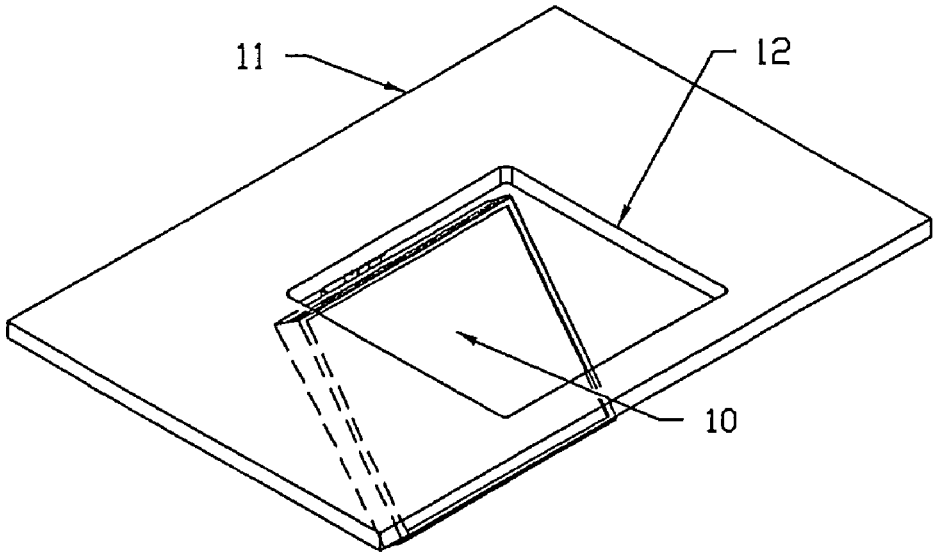
FIG. 9 depicts a front isometric view of a sub-surface configuration of a flat panel monitor mounted on a standard work surface.

FIG. 4-9 depict some mounting configurations with hidden-line views. FIGS. 4 and 5 show hidden-line views of the VESA mount configuration depicted in FIGS. 1 and 2. FIGS. 8-9 shows hidden-line views of the VESA mount configuration depicted in FIG. 3.

FIGS. 4-7 depict semi-recessed mounted views of flat panel monitor mount on a standard work surface. FIG. 4 shows a rear view, FIG. 5 is a top and front view, FIG. 6 is a side view and FIG. 7 is a rear and top view. (10) Denotes a flat-panel monitor affixed to said mounting configurations. (11) Denotes a standard work surface. (12) Is a cut-out in a work surface for flat display mounting system mechanism.

FIGS. 8-11 depict sub-surface mounting configurations. FIG. 8 shows the side view of a sub-surface mounting configuration of a VESA standard flat panel monitor mount, partially extended to show adjustment possibilities. (2) Mounting plate pivot point. Two security screws act as a tight pivot with friction damping washers (either felt or nylon) in between. (8) Pivot point extender arm for subsurface mount application.

Figure 10:
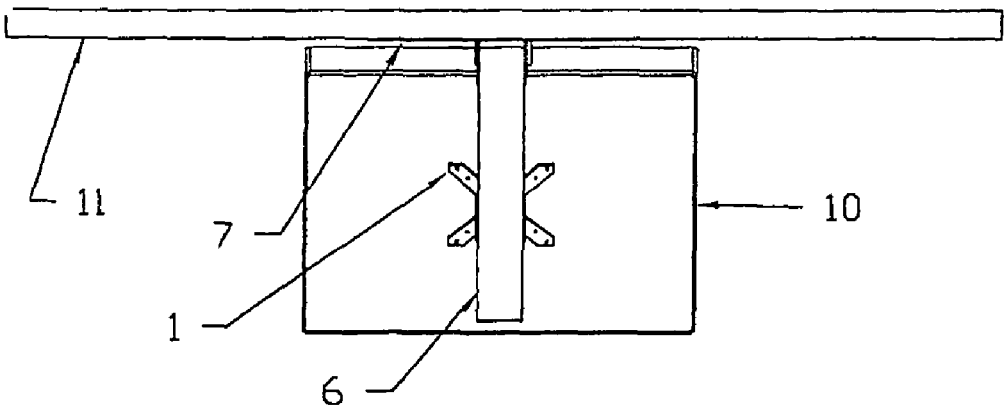
FIG. 10 shows a back view of a sub-surface configuration of a flat panel monitor mounted on a standard work surface.
Figure 11:
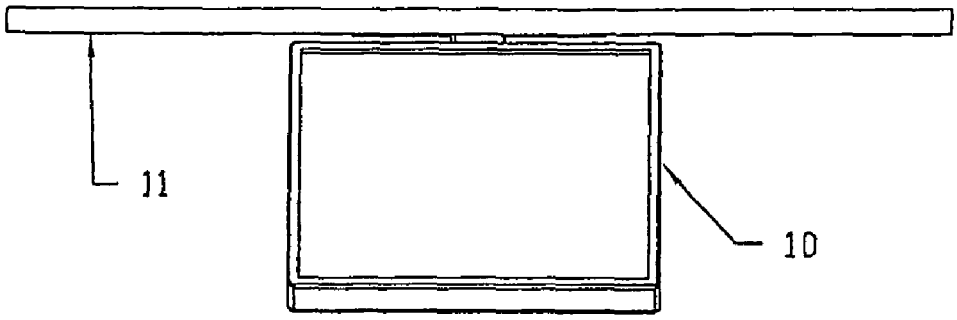
FIG. 11 shows a front view of a sub-surface configuration of a flat panel monitor mounted on a standard work surface.

FIG. 9 shows a top and front view of a sub-surface mounting configurations with hidden-line views. FIG. 10 shows a hidden-line back view of the rear of the VESA mount configuration. FIG. 11 shows a front hidden-line view of the VESA mount configuration, fully extended to show the full range of adjustment possibilities.

The invention includes an adjustable flat panel monitor mounting system comprising:

a) a VESA compliant flat panel display securably mounted to a VESA compatible mounting plate, said flat panel monitor fastened to said mounting plate using security screws.

b) a height set point using security screws to fixedly set a predetermined height;

c) a riser bar which adjust up or down upon installation, and is changed with tools to change the height for new equipment or for a new configuration, said riser bar comprising a channel for the passage of wires; and d) a work-surface mounting bracket mounted to the underside of a work-surface either with the channel mount up or down to a user desired configuration.

The invention also includes an adjustable flat panel display mounting system, wherein a VESA compatible mounting plate fits both the VESA 100 and VESA 75 standard mounting hole patterns on flat panel displays, and/or wherein the VESA compatible mounting plate is mounted in a subsurface configuration.

Having now fully described this invention, it will be understood to those of ordinary skill in the art that the same can be performed within a wide and equivalent range of conditions, formulations, and other parameters without affecting the scope of the invention or any embodiment thereof. All patents and publications cited herein are incorporated by reference in their entirety.

I claim:

1. An adjustable flat panel monitor mounting system for securely mounting a flat panel monitor to a work surface comprising:

a. the work surface having a topside and underside, b. a VESA compatible mounting plate or other industry standard or custom mounting plate for mounting said flat panel monitor using industry standard fasteners for holding said flat panel monitor to said mounting plate which is attached to, c. a height set point adjusting system including a riser bar which uses industry standard fasteners to set a selected height for said mounting plate and which is attached to, d. a surface mounting bracket attached directly to said underside of said work surface with said mounting plate positioned such that the monitor, when positioned in the working position, is located in a semi-recessed position with regard to said topside of said work surface.

2. The mounting system of claim 1 wherein said height set point adjusting system further comprises a height adjusting system for said mounting plate wherein said riser bar is slidably attached to said surface mounting bracket allowing said riser bar to adjust up and down by the use of industry standard fasteners and compatible adjusting tools to vary the height of said mounting plate in relation to said work surface.

3. The mounting system of claim 1 wherein the mounting plate is pivotally mounted to said riser bar with industry standard fasteners.

4. The mounting system of claim 1 wherein said riser bar has a channel to allow wiring and cables to pass therein.

5. The mounting system of claim 1 wherein said surface mounting bracket is fixedly attached to the underside of said work surface with the use of industry standard fasteners and wherein the surface mounting bracket can only be removed with a tool capable of operating said industry standard fasteners.

6. An adjustable flat panel monitor mounting system for securely mounting a flat panel monitor to a work surface having a topside and underside comprising:

a. a VESA compatible mounting plate or other industry standard or custom mounting plate for mounting said flat panel monitor using industry standard fasteners for holding said flat panel monitor to said mounting plate which is attached to, b. a height set point adjusting system including a riser bar which uses industry standard fasteners to set a selected height for said mounting plate and which is attached to, c. a surface mounting bracket adapted to be attached to said underside of said work surface with said mounting plate positioned such that the monitor, when positioned in the working position, is located in a semi-recessed position with regard to said topside of said work surface.

* * * * *